United States Patent [19]

Vaughan, IV

[11] Patent Number: 4,845,019

[45] Date of Patent: Jul. 4, 1989

[54] METHOD FOR EXPOSING AND DEVELOPING PHOTOSENSITIVE MATERIALS

[75] Inventor: Quentin D. Vaughan, IV, Davie, Fla.

[73] Assignee: Visicon Laboratories, Inc., Oak Ridge, Tenn.

[21] Appl. No.: 117,902

[22] Filed: Oct. 29, 1987

Related U.S. Application Data

[62] Division of Ser. No. 871,813, Jun. 6, 1986, abandoned.

[51] Int. Cl.[4] ..... G03C 5/24; G03C 5/44

[52] U.S. Cl. ..... 430/422; 430/4; 430/393; 430/423; 430/428; 430/430; 430/434; 430/436; 430/438; 430/448

[58] Field of Search ..... 430/422, 4, 430, 423, 430/428, 434, 436, 438, 448, 393

[56] References Cited

U.S. PATENT DOCUMENTS

| | | | |
|---|---|---|---|
| 2,163,820 | 6/1939 | Willmanns et al. | 430/464 |
| 2,306,923 | 12/1942 | Wood et al. | 430/464 |
| 2,582,001 | 1/1952 | Bornemann et al. | 101/131 |
| 2,652,428 | 9/1953 | Weissberger et al. | 430/464 |
| 2,751,814 | 6/1956 | Limberger | 58/24 |
| 3,131,621 | 5/1964 | Murray | 354/322 |
| 3,462,221 | 8/1969 | Tajima et al. | 355/77 |
| 3,536,401 | 10/1970 | Mason et al. | 355/28 |
| 3,728,954 | 4/1973 | Everett et al. | 354/322 |
| 3,751,161 | 8/1973 | Berman et al. | 355/27 |
| 3,833,918 | 9/1974 | Stievenart et al. | 354/321 |
| 3,864,082 | 2/1975 | Kato | 430/464 |
| 3,906,536 | 9/1975 | Graham | 354/319 |
| 4,185,912 | 1/1980 | Schwartz | 355/28 |
| 4,227,786 | 10/1980 | Zorn et al. | 354/10 |
| 4,277,557 | 7/1981 | Jäger et al. | 430/463 |
| 4,327,987 | 10/1980 | Friar et al. | 354/317 |
| 4,328,306 | 5/1982 | Idota et al. | 430/430 |
| 4,427,761 | 1/1984 | Charles | 430/291 |
| 4,461,556 | 7/1984 | Douglas | 354/303 |
| 4,464,035 | 8/1984 | Schoering | 354/325 |
| 4,490,030 | 12/1984 | Acklin et al. | 354/322 |
| 4,508,334 | 4/1985 | Iwanaga | 271/308 |
| 4,519,689 | 5/1985 | Kinsman et al. | 354/304 |
| 4,528,261 | 7/1985 | Hauser | 430/322 |
| 4,534,635 | 8/1985 | Johnston et al. | 354/322 |
| 4,548,884 | 10/1985 | Heiart | 430/22 |
| 4,556,302 | 12/1985 | Schaut et al. | 355/27 |
| 4,604,344 | 8/1986 | Irving et al. | 430/325 |
| 4,695,530 | 9/1987 | Nakamura et al. | 430/430 |

FOREIGN PATENT DOCUMENTS

| | | | |
|---|---|---|---|
| 2474708 | 7/1981 | France . | |
| 629823 | 12/1961 | Italy | 354/319 |
| 2075215B | 7/1984 | United Kingdom . | |

OTHER PUBLICATIONS

T. H. James "The Theory of the Photographic Process", MacMillan Publishing Co., N.Y. pp. 298–299 1977.

Visual Graphics Typositor 4000 Display Phototypesetter.

The Spectra Setter 1200.

The Visual Graphics Daylighter Vertical Camera System.

C.P.I. Model 40 SCA.

C.P.I. Emeraude and Super Emeraude.

Log Etronics, Inc. Excel Rapids Access Processors 25 & 32.

Kenro Corp. Table Top Rapid Access Processors.

Ilford Cibachrome Process 22 brochure.

Ilford Cibachrome Copy Paper & Cibachrome Copy Film Photographic Color Copies & Transparencies.

The Ilford Cibachrome II Corrective Masks brochure.

*Primary Examiner*—Mukund J. Shah

*Attorney, Agent, or Firm*—Luedeka, Hodges & Neely

[57] ABSTRACT

The methods and apparatus disclosed herein provide commercially viable means to selectively improve the input and output characteristics of photosensitive materials, especially the output contrast variables. The present invention allows commercially available photosensitive material such as the high contrast Ilford Cibachrome Copy CCO Paper® to display dramatically improved color balance and contrast range characteristics when making reproductions from slides or prints. Recreational, professional and military photo duplication techniques are greatly improved by the present invention.

14 Claims, 2 Drawing Sheets

IN
OUT
M VS

IN
OUT

DIRECTION OF BELT MOVEMENT

LIGHT BAFFLE

IN
IN
OUT

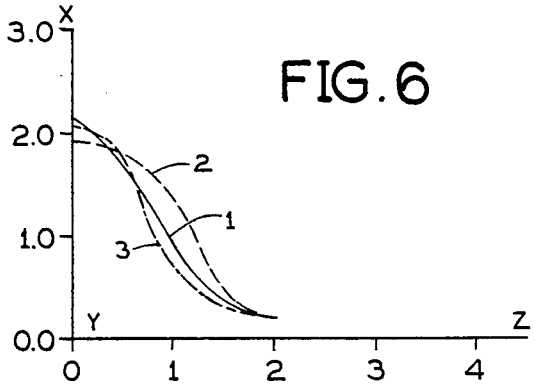
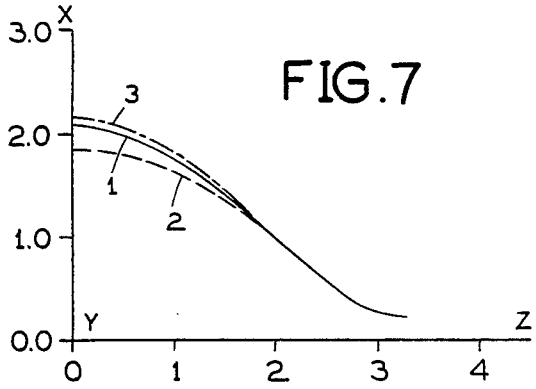
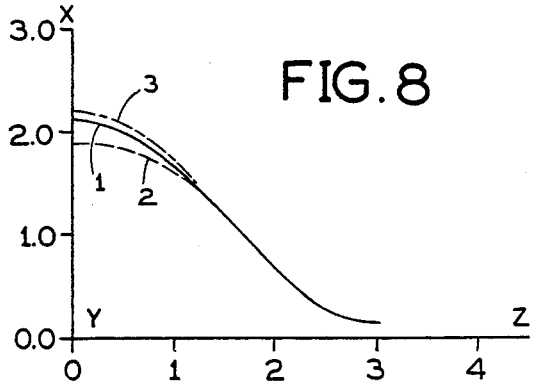
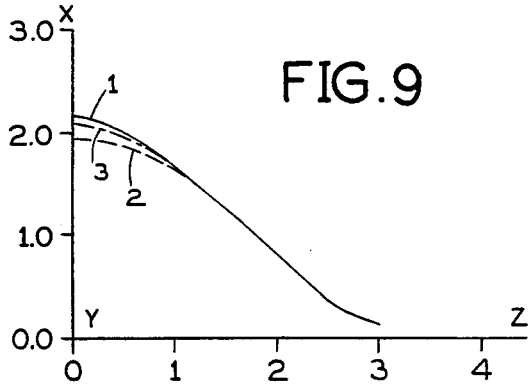
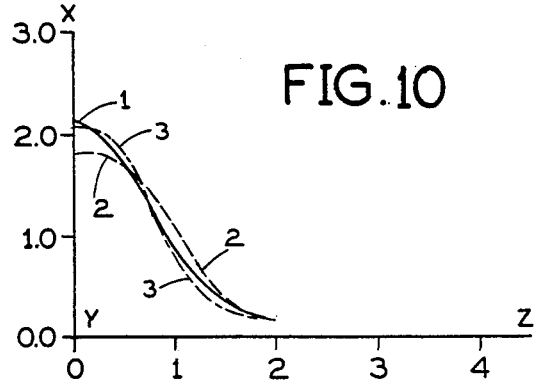
COLOR CODES (FIG. 1-5)
1 - MAGENTA ————
2 - CYAN – – – – – –
3 - YELLOW — - — - —
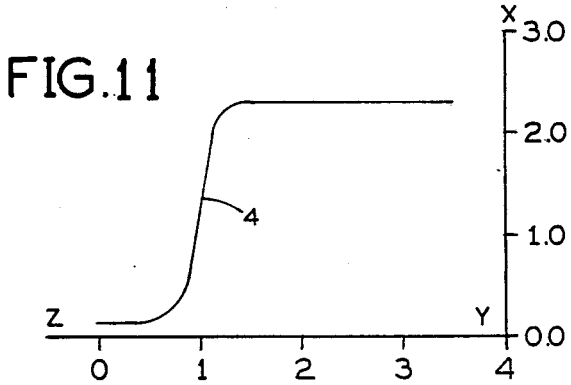
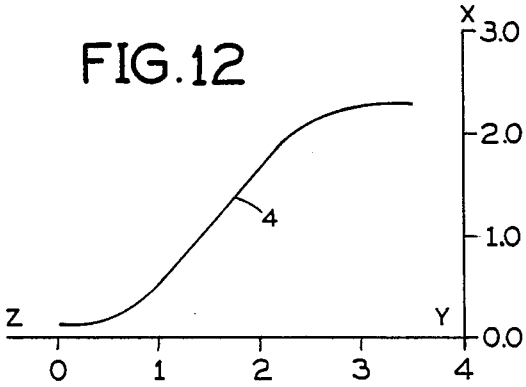

METHOD FOR EXPOSING AND DEVELOPING PHOTOSENSITIVE MATERIALS

This application is a division of application Ser. No. 06/871,813, filed June 6, 1986, now abandoned.

FIELD OF THE INVENTION

The present invention relates to improving the reproduction characteristics of photosensitive materials by commercially viable means. Throughout this application the term photosensitive material is abbreviated to PSM. Photosensitive materials include film, papers and foils which have been coated with a light sensitive substance containing one or more silver based compounds.

BACKGROUND OF THE INVENTION

The Method

The vast majority of presently used photographic processes depend on utilizing a film or paper substrate onto which a light sensitive silver based chemical compound has been coated along with other substances such as gelatin or dyes. A PSM can record a narrow spectral range, a wide spectral range, or several spectral ranges simultaneously. The final results are dependent on the changes occurring in the light sensitive (photosensitive) silver based layer(s) during exposure and subsequent development. The overall characteristics of any particular PSM, including such factors as spectral sensitivity, contrast, color balance, speed, density, tonal rendition, etc. are normally "locked in" during the manufacturing process, e.g. if a particular PSM is manufactured to produce or record only a high contrast image, little can normally be done to alter this basic characteristic using existing methods.

Whether the PSM is meant to depict final results in black and white, color, or otherwise, one of the most important factors dictating the suitability of a particular PSM for a particular purpose is contrast. While certain modifications to contrast characteristics are possible using methods such as those outlined below, these methods have severe limitations.

The present invention describes a means and apparatus for selectively altering the inherent contrast characteristics of the light sensitive silver layer(s) in a silver based PSM. In dealing with black and white photosensitive materials this can involve as few as one photosensitive silver layer. In the case of so-called "color" materials, it can involve several photosensitive layers coated one over the other on the same substrate and disposed in such a way that each layer will record only a particular region of the total spectrum (usually the red, blue and green "primary color" regions).

In one way or another, depending on the exact nature of the particular color PSM being utilized, the latent image recorded by each individual light sensitive silver layer is converted by subsequent processing steps into a color image corresponding to the spectral sensitivity of each individual layer and in proportion to the amount of exposure each layer received. Further processing steps usually remove all of the exposed or unexposed silver compounds leaving only the color dyes on the substrate.

Photographic materials are generally divided into basic categories: color, black and white, negatives, prints, slides, instant prints, etc. Common among these are photographic "prints" which are usually made by taking a picture with a camera on a special type of film which is chemically processed by a laboratory—first as a film "negative"—which is then used to make a reproduction on paper which is called a "print." Prints may be either black and white or color depending on the type of negative film used to take the original picture.

Another common way of taking pictures is by using a different type of film which results in a color slide. A picture is made with a camera and the exposed "film" is then chemically processed by a laboratory. The result is a piece of positive film commonly mounted in a cardboard frame called a "slide." To view slides they are most often projected onto a screen or wall.

By using special types of paper such labs can also make prints directly from "slides," but the results are often less than satisfactory. Prints made from slides can also be produced by using a special "internegative" process. In this case a special type of film is used to make a negative from the original slide, then the resulting "internegative" is used to make a paper prints.

Since the advent of practical photographic methods during the last century enormous progress has been made in improving the overall quality of photographic materials and processes. One of the problems still encountered is minimizing the losses in detail usually experienced when making reproductions from original negatives, transparencies, or other prints. When making reproduction with any photographic process it is desirable to utilize the least number of steps possible, (ideally one) since each additional step (generation) usually causes some detail to be lost or altered.

Some of the factors involved in the reproduction processes are: "resolution"—the ability of the reproduction material to depict the small detail recorded on the original film; "graininess"—this is the undesirable sand like appearance sometimes seen in prints or slides; in the case of color materials, "color balance"—the ability to accurately and faithfully reproduce the colors in the original picture; "contrast"—the visible difference between the lightest and the darkest areas in a picture. A color slide taken at the beach on a sunny day represents an example of a high contrast picture, that is the slide will show a large visible difference between the darkest and brightest areas in the picture. A similar slide taken on a rainy day would represent a low contrast picture; that is, the visible difference between the darkest and lightest areas in the picture would be considerably less than the difference seen in a high contrast slide.

Due to such commonly encountered lighting conditions the photographic record of such events often exhibit very high contrast ratios (1000:1); that is, the lightest area in a picture is 1,000 times lighter than the darkest area. Sometimes this difference can even be greater than 1000:1.

There are several methods commonly used to produce prints:

A. DIRECT POSITIVE PRINTS: In this process the prints are made directly from "transparent" originals, such as 35 mm color slides, which appear visually the same as the original scene (a positive image).

B. NEGATIVE PRINTS: Prints are made using film "negatives" to produce a positive "print" on paper or film.

C. INTERNEGATIVE PRINTS: With this method an intermediate "negative" is made from a positive original (a slide most commonly) and the "internegative" is then used to make a "print" on paper or film.

D. DYE TRANSFER PRINTS: A highly labor intensive and very expensive "manual" method requiring multiple steps to make a print.

Due to inherent differences between the characteristics of the photosensitive material (PSM) used to record original subject matter and the characteristics of the PSM used to reproduce copies of such originals, detail and other desirable image characteristics are often lost, degraded or altered.

To make reproductions from originals which have high contrast ratios, such as 1000:1, the PSM used to made the reproduction must have the ability to record such a high ratio; otherwise the detail or information container in the original will be lost or degraded during the reproduction process. Presently available photosensitive papers generally are capable of recording contrast ratios of less than 500:1. This means that reproductions made without intermediate steps on such materials will result in a significant loss of information. Reproductions produced by means of intermediate steps, such as internegatives, are able to record the contrast ratio of the original more closely, but they suffer from other deficiencies introduced by the multiple generation steps required.

Several techniques have been developed over the years to improve the inherent material limitations in making reproductions, but they too have limitations. Such techniques include:

MODIFICATION TECHNIQUES

1. Manual Exposure Techniques: It has been possible for decades to modify selected portions of photographs during exposure by simply blocking, or "holding back" the light reaching the PSM by means of various opaque objects, including the human hand. Conversely it is also possible to allow more light to reach selected areas of the PSM by similar means—usually by using an opaque substance with a hole in it to permit the light to pass through it onto the desired area. Both of these techniques permit limited modification but they also require a great deal of skill and experience to achieve satisfactory results. They are quite laborious and do not lend themselves to repeatability or high production.

2. Supplemental Exposure Techniques: Variations of this technique generally depend on post, simultaneous, or pre exposure of a PSM in addition to a main exposure in order to alter the overall contrast range of a resulting "print." Unfortunately, the amount of modification possible utilizing this method is generally quite limited and usually results in overall degradation of the resulting image, including color characteristics.

3. Processing Modifications: By modifying certain processing parameters such as time, temperature, or composition of processing chemicals, it is possible to alter the contrast ratio to a limited extent. Given the vast number of available processes it is not practical to outline each here. As with the previous two methods the effect is limited and very inconvenient when prints are being made from mixed contrast ratio originals. Color balance is usually adversely affected by such methods and effectively offsets any gains in contrast ratio improvement.

4. Corrective Masks: A transparent original itself may be used to produce custom "masks" for contrast and/or color control when working with color PSM. Such masks permit modification of the contrast ratio of the original to more closely match that of the PSM being used to make the reproduction. Such masks are time consuming to produce and difficult to accurately register, particularly with small format originals. Since one or more such masks may have to be made for each original; the cost and complexity is substantial and generally requires the judgement of a highly skilled operator.

5. Optical Devices: Various methods of optical modifications are possible which permit some alteration of contrast ratios. These methods generally work either by inducing extraneous light (flare) into the optical path, or by purposely diffusing the light rays in some manner. These techniques range from the use of a highly diffused light source to various diffusion devices placed in the image forming light path of the system. Although some beneficial improvement in overall contrast range may be achieved, it is usually at the cost of overall image degradation.

6. Electronic Imaging: Recently a great deal of progress has been made in modifying images by electronic means. While the ability to modify contrast ratios and certain other image characteristics is very good, the resolution capabilities of present electronic devices used to reproduce "hard" copies is generally poor. The cost of such systems is also usually quite high due to the elaborate equipment required.

7. Variable Contrast Photosensitive Materials: Several black and white materials are available which permit variation of the contrast ratio selectively by utilizing special filtration techniques. The degree of contrast modification possible is quite limited, usually ranging from 50:1 to 6:1 ratios. Multicolor materials/processes with such capabilities are not presently available.

THE APPARATUS

Most presently known devices for imaging PSMs employ a means of transporting, positioning and exposing dry sheets of photosensitive materials to a source of light by means of a system of rollers or vacuum belts. Following exposure the dry photosensitive material is further transported by additional rollers or belts into a processor which has one or more containers filled with liquid chemical processing mixtures. Other methods employ gels of chemical mixtures which are applied to a dry photosensitive material following exposure by means of a system of rollers (such as in a Polariod camera). Still others employ means by which dry PSM is transported, exposed or processed by threading long rolls of the PSM through appropriate apparatus and winding it up on the end of a take-up spool (such as is done with movie films). Still others employ means by which the PSM is exposed to a source of light while immersed in a liquid chemical mixture (such as in a Phototypositor).

The mechanical complexity of all of the above methods is largely dependent on the size range of materials being handled, and the number of chemical steps involved, i.e. a processor designed to handle film sizes ranging from 4"×5" to 20"×24" with a system of rollers would require a minimum width of 20" but roller pairs could not be more than 5" apart or the smallest sheets could not be transported. Continuous systems like movie processors generally handle only certain discrete sizes, usually under 70 mm in width. With the exception of a "Phototypositor" all of the above methods deal with pre-exposed "dry" photographic materials.

SUMMARY OF THE INVENTION

The Method

Regardless of whether the PSM is color, or black and white, all of the PSMs covered by the present invention function by the well known effects caused by some form of radiation (i.e. light) striking a "photosensitive" silver compound which has been coated onto a substrate.

The present invention affects the contrast characteristics of the PSM. The present invention's uniqueness centers on the ability of control the contrast characteristics of the silver layer(s). The present invention can modify (stretch) the contrast level of any PSM that uses light sensitive silver based technology.

The practical, and commercially valuable, advantage of the present invention is that it permits using just one PSM to reproduce, or record virtually any contrast range desired. Other processes require several different "contrast grades" or specific types of PSM to do this. With some processes it is generally considered impossible to produce a low contrast print (as with the high contrast Cibachrome CCO paper for example).

Accordingly, it is the object of the present invention to provide a means of selectively modifying the input and output characteristics of a silver based PSM, especially contrast variables.

Another object of the present invention is to provide a means for selective modification of the relative spectral response characteristics of color PSM to the range of wavelengths included in the spectrum.

Another object of the present invention is to provide the means to make reproductions on PSM from high contrast ratio originals in a single step by expanding the input exposure range of the PSM.

In practicing the present invention there is utilized a pre-coated photosensitive material (PSM). Suitable materials within the scope of this invention include monochromatic (B&W) and color films, papers and other substrates capable of being coated with photosensitive compounds, dyes, or other substances capable of forming images when used alone or in combination with other photosensitive compounds. Chromogenic and silver-dye-bleach color photographic processes are commonly used PSMs which can benefit from the present invention. The present invention is hereinafter referred to as "the C&CC method."

SUMMARY OF THE C&CC METHOD

STEP 1. In a light controlled environment appropriate for the particular material being used, the PSM is wetted with a mixture containing one or more photoreactive chemicals, such as developing or activating agents, for a pre-selected period of time and at a controlled temperature. The composition of the chemical mixture depends on the type of PSM being utilized and the final result desired.

STEP 2. After the pre-selected time has elapsed (which may be up to several minutes), excess liquid is removed from the surface of the material. The moist material is then exposed to a source of radiation for a period of time. The exact time depends on the intensity and other properties of the radiation source, the particular properties of the PSM being used, and the final result desired.

STEP 3. After exposure the material is then wetted with additional chemical mixtures to complete the chemical processing of the material. The exact chemical composition, sequence, and the total number of these mixtures is dependent upon the processing requirements for the particular type of PSM being utilized and the final result desired.

STEP 4. After the subsequent processing steps are completed, the material is dried and the finished reproduction is ready for use.

APPARATUS

In one embodiment of the present invention there is provided a horizontal means of support which may be attached to or made part of a large format camera, enlarger or similar imaging device. The support carries an endless plastic belt which forms both the transport mechanism and the image plane. This belt is held taut by rollers placed within the circumference of the belt. The rollers are connected by mechanical means to a motor. Additional rollers are mounted as required for the process being utilized within and without the circumference of the endless belt. An environmentally controlled (temperature and light in this case) housing surrounds the processing sections of the endless belt. Exposure to light in the image plane area is controlled by a shutter or other control device on the camera or enlarger. A flexible plastic mesh and a flexible plastic sheet are joined together on one end with a hollow plastic channel. A flexible plastic hose, connected on one end to a liquid reservoir (having flow and temperature controls) is connected to the plastic channel. The opposite end of the plastic channel is sealed. The "mesh assembly" is then positioned near the outfeed side of the first roller mounted outside the circumference of the belt in a manner that will permit a certain amount of vertical movement. Additional similarly connected "mesh assemblies" are positioned as required on the outfeed sides so subsequent rollers. When it is desired to make a print using the C&CC method, the belt motor is activated and a flow of chemicals is started which wets the belt. Then a sheet of the photosensitive paper is fed into the "nip" created by the belt and the first top mounted roller. The rotating roller presses the paper against the moving belt forcing both air and liquid out of the space between the paper and the belt. After passing through the "nip" the paper then passes beneath the mesh assembly where a liquid is applied (in this case a mixture of developing agents and water). After emerging from beneath the mesh assembly the paper then enters the "nip" of the second top mounted roller where most of the liquid is removed by the squeegeeing action of the roller. The paper is then transported in its moist state and positioned for exposure by stopping the belt movement. After the exposure has been completed, the belt carrying the paper is restarted and the paper enters the nip of the third top mounted roller and beneath the mesh assembly where the next chemical is applied in the same manner as previously used. Subsequent processing steps are essentially identical except for the nature of the chemicals. After processing is complete, the paper exits from the nip of the last top mounted roller where, as a result of the belt rotating in a downward direction, the paper breaks the surface tension bond and separates from the belt. The paper is then guided out of the environmentally controlled enclosure and into a dryer or catch tray.

In another embodiment of the invention, the various processing and exposure steps are physically separated by means of employing individual belt/roller/mesh assemblies oriented in relation to one another at different angles. The paper is inserted into the "nip" between a horizontally mounted and moving belt/roller as before, and it passes beneath the mesh assembly, and into the "nip" of the squeegee roller as before, but the surface tension bond is broken immediately after exiting the squeegee roller by the shorter belts downward rotation. The paper is then guided into the "nip" where another roller presses the still moist paper onto the upwards moving surface of a vertically mounted endless belt. The belt is stopped when the paper reaches the desired position for making an exposure. After the exposure has been completed, the direction of the belt movement is then reversed and the paper is now transported in a downward direction until it exits the roller nip and breaks free from the belt. The paper is then guided into the nip of the next station where it is affixed by a roller pressing it onto the downward moving surface of an endless belt mounted at an angle of 45°. The paper continues to pass through the remaining mesh assemblies and rollers until the processing is complete. It is then guided out of the environmentally controlled enclosure into a dryer or catch tray.

In yet another embodiment of the invention the mesh assembly is modified so that it consists of mesh material secured on one end by a channel which is secured to one edge of a plastic plate of the same or greater thickness. The channel is again connected by a hose to a liquid reservoir on one end and sealed on the other end. Adjacent to a parallel with the mesh assembly are the plastic or metal plates located one on each side of the mesh. The plates are textured or covered with a mesh like or textured material to prevent unwanted adherence by paper or film sheets and the infeed edges are shaped to guide paper into intimate contact with the wet mesh material. The above apparatus may be placed in an environmentally controlled enclosure if necessary.

Another embodiment is suited for use with a dual sheet "diffusion transfer" type of photosensitive material such as Eastman Kodak's PMT II. With this type of material one of the sheets (donor) has already been exposed to light creating a latent image on the donor. It must now be wetted with a liquid containing a developing and/or activating agent for a period of time and then made to come into intimate contact with a second sheet of material known as a "receiver." This is usually accomplished in present art by immersing both materials simultaneously in a tank of "chemical" keeping them separated during this time and then guiding them into a pair of squeegee rollers where the two sheets are brought into intimate contact while still wet. The excess chemical is removed by the roller pressure applied to the back surfaces of the two sheets. The sheets remain "sandwiched" together for a period of time during which the image on the donor is chemically transferred to the receiver. Then the sheets are separated.

In the present invention the mesh assembly is secured between the aforesaid textured plates and positioned adjacent to infeed devices such as rollers or belts which permit simultaneous guiding of both the donor and receiver sheets into contact with opposite sides of the mesh. Adjacent to the mesh/plate assembly on the outfeed side is located and mounted a pair of squeegee rollers which are mechanically linked to a source of power and synchronized with the infeed side devices. In operation the already exposed donor sheet and the receiver sheet are inserted simultaneously into the infeed side of the mesh-plate assembly with the latent image and receiver sides facing each other. They are then guided by the plates into intimate contact with opposite sides of the wet mesh. After passing the end of the mesh the two sheets are then allowed to come into intimate contact with each other immediately before entering the squeegee roller nip. Upon entering the roller nip the excess "chemical" is removed by the pressure exerted on the outside surfaces of the material by the rollers and the completed "sandwich" is allowed to exit. After a period of time the two sheets are separated. As can be seen in FIG. 5 there is "no tank" in the present invention.

It is also possible to insert paper, position it beneath the mesh and stop it—reversing the motor direction repeatedly back and forth just keeping the material wet to provide agitation.

In the present invention there has been provided a highly simplified apparatus suitable for use with a wide variety of types and sizes of photographic materials which is capable of handling various processing chemicals with widely differing characteristics. The apparatus is suitable for use with black and white and color photographic materials and processes (which are wet prior to, during and after exposure).

Accordingly, it is an object of the present apparatus invention to provide a means which is capable of transporting wet or moist photosensitive sheet materials prior to exposure, during exposure and following exposure into and through subsequent processing steps.

Another object of the present invention is to provide an apparatus which is capable of being used in combination with large format cameras, enlargers and other such imaging devices.

Another object of the present invention is to provide an apparatus which is capable of transporting photosensitive materials exhibiting wide variations in thickness and size with little or no adjustments being required.

Another object of the present invention is to provide an apparatus which is capable of utilizing both black and white or color PSM as desired.

Another object of the present invention is to perform the above outlined operations without the requirement of being positioned horizontally. It may also be positioned vertically, horizontally inverted or it may be positioned longitudinally at an angle.

Another object of the present invention is to permit the application of liquid by several methods including rollers, liquid curtains, sprays, sponges, baths or meshes.

Another object of the present invention includes an embodiment which will function in a weightless environment such as in a space vehicle. This embodiment includes a suction device means for removing excess liquids rather than a conventional trough under the PSM which depends on the principle of gravity.

Other objects of this invention will appear from the following description and appended claims, reference being made to the accompanying drawings forming a part of this specification wherein like reference characters designate corresponding parts in the several views.

BRIEF DESCRIPTION OF THE DRAWINGS

In the accompanying drawings forming part thereof similar elements have been given the same reference numerals, in which drawings:

In FIGS. 6 through 12 the x-y axis depicts the measured reflection density of prints as compared to the log relative exposure depicted on the y-z axis as follows:

FIG. 6 depicts typical characteristic curve results of each of the three color layers as obtained by processing the color photosensitive material according to the manufacturer's recommendations.

FIG. 7 depicts the characteristic curve results of each of the three color layers as obtained by processing the same color photosensitive material depicted in FIG. 6 using the C&CC method as performed in Example 1.

FIG. 8 depicts the characteristic curve results of each of the three color layers as obtained by processing the same color photosensitive material depicted in FIG. 1 using the C&CC method as performed in Example 2.

FIG. 9 depicts the characteristic curve results of each of the three color layers as obtained by processing the same color photosensitive material depicted in FIG. 6 using the C&CC method as done in Example 3.

FIG. 10 depicts the characteristic curve results of each of the three color layers as obtained by processing the same type of color photosensitive material depicted in FIG. 1 using the manufacturers' recommendations but altering the color balance with color filtration to illustrate a "crossover" condition. Such a crossover in two spectral curves is not normally correctable by means of filtration since the results of such filtration result in an essentially parallel movement in any curve and cannot correct in one segment of the curve without exaggerating discrepancy even further in another segment. Although the color curves were shifted it can be seen that such filtration did not alter the contrast characteristics.

FIG. 11 depicts the characteristic curve results obtained by processing the black and white photosensitive material according to the manufacturer's recommendations.

FIG. 12 depicts the characteristic curve results obtained by processing the same black and white photosensitive material using the C&CC method as performed in Example 5.

Figure 1:
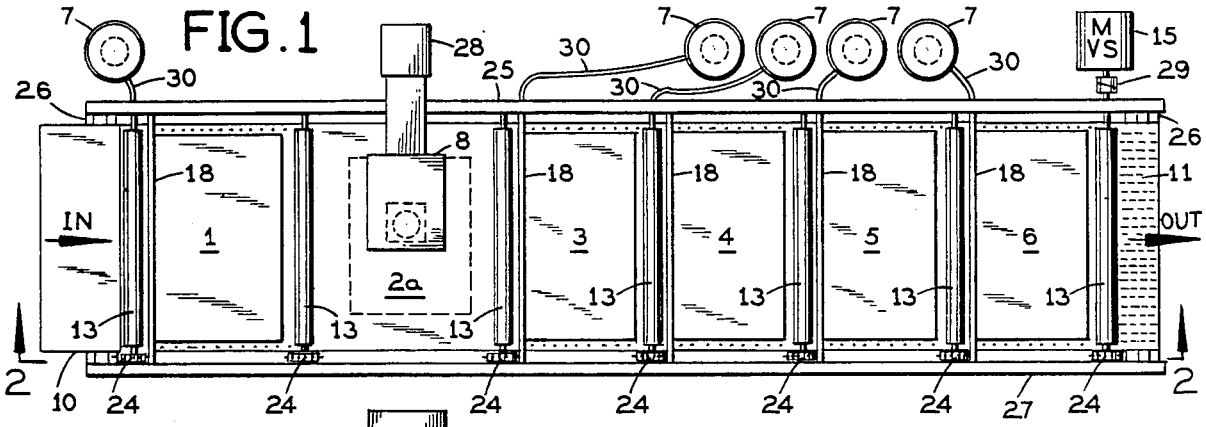
FIG. 1 is a top plan view of the complete embodiment of one version of the present invention without the enclosure cabinet.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE METHOD INVENTION

In all of the following examples the photosensitive material is handled in a lighting environment appropriate for the particular material being utilized, such as under a "safelight" or total darkness. The PSM was exposed by using a commercially available photographic enlarger equipped with a tungsten halogen light source of 85 watts having a color temperature of 3,200° Kelvin and a "color corrected" lens having a focal length of 50 mm. No corrective masks were used.

I. COLOR PROCESS

A commercially available high contrast, direct positive silver-dye bleach photosensitive color paper was used in examples 1 through 4. This particular PSM, when processed according to manufacturer's recommendations, has an exposure input range of approximately 65:1. Color photosensitive materials exhibiting such high contrast characteristics are not normally suitable for reproducing visually satisfactory prints made from high quality continuous tone color transparencies. Commercially available PSMs include Kodachrome®, Fujichrome®, Agfachrome® or similar types of transparent originals.

The manufacturer's recommended procedure for this particular PSM is: Step A—Exposure to a source of visible light. Following exposure, the recommended chemical processing sequence is: Step B—Development; Step C—Bleaching; Step D—Fixing; Step E—Washing; Step F—Drying.

The detailed manufacturer's standard method for developing this PSM follows below and is referenced in Examples 1 through 4 below. Similar procedures for black and white processing of PSM as referenced in Examples 5 and 6 are well known in the art.

CIBACHROME Process P-22 is the rapid process of the CIBACHROME COPY SYSTEM. It comprises three chemical baths, namely developer, bleach bath and fixer, and a final water wash step. The processing solutions are not meant to be replenished, they are used until they are exhausted and then replaced.

Process P-22 is used for the rapid and simple processing of CIBACHROME COPY PAPER (CCO 895) and CIBACHROME COPY FILM (CTR 661). It was designed for the camera processor CIBACHROME COPY 002, but it can also be used in suitable independent roller transport processors, in particular in the modern and compact table top models. P-22 should not be used in rotating drum machines, nor in tank lines, trays or daylight tanks.

P-22 is silver-dye bleach process matched to the CIBACHROME COPY materials. Other CIBACHROME products, such as CIBACHROME PRINT, CIBACHROME TRANSPARENT, CIBACHROME-A, CIBACHROME-RC or CIBACHROME-PS do not give a satisfactory print quality in process P-22.

PROCESSING IN P-22

Standard Processing Conditions

By definition, the processing time is the interval between immersion in one bath and immersion in the next bath; it includes the transfer time from one bath to the next. This transfer time should be kept below 30% of the immersion time.

| Solution | CIBACHROME COPY PAPER | CIBACHROME COPY FILM | Temperature |
|---|---|---|---|
| 1. Developer DE-22 | 45 seconds* | 90 seconds* | 39 ± ½° C. |
| 2. Bleach bath BL-22 | 60 seconds | 120 seconds | 39 ± 1° C. |
| 3. Fixing bath FX-22 | 60 seconds | 120 seconds | 39 ± 1° C. |

-continued

| Solution | CIBA-CHROME COPY PAPER | CIBACHROME COPY FILM | Temperature |
|---|---|---|---|
| 4. Wash | 60 seconds** | 120 seconds** | 37–40° C. |

*For machines in which the treatment times in all three chemical solutions are identical the development time can also be 60 seconds or 120 seconds respectively. This requires a slight change of the corrective filtration and produces a somewhat lower contrast, especially for CTR 661.

**If the machine has two wash tanks the wash time can be 2 × 30 seconds and 2 × 60 seconds respectively. There must be two wash tanks if standing water is used rather than running water, and the water must be changed at the latest after half, better after one third of the expected solution capacity is used up.

The treatment steps 1 and 2 require complete darkness; after the bleach bath normal room lighting can be used.

Solution Circulation

The machines for process P-22 require the usual circulation pumps for the chemical tanks. The pump performance should be such that the tank volumes are circulated about once per minute for small machines and about once every two minutes for larger machines. This produces enough turbulence to ensure an efficient solution exchange at the surface of the CIBA-CHROME material, and at the same time guarantees a uniform temperature throughout the bath.

Washing

When working with running water an adequate supply of water at 37°–40° C. must be available to allow constant operation of the machine. If colder water is used there is a risk of insufficient washing and consequently of reduced light stability of the prints. If the water is very cold, the highlight areas can turn yellowish and, in extreme cases, reticulation of the gelatin may occur. The minimum amount of water depends on the size or capacity of the machine; it may be calculated as follows:

$$W=(b\cdot v)/550$$

W = required amount of water, in liters per minute
b = working width of the machine, in cm
v = speed of the machine, in cm per minute Example: Working width = 32 cm, speed = 45 cm per minute Wash water required = (32×45)/550 = 2.6 liters per minute (minimum)

When washing with standing water, the wash tanks must be equipped with a temperature control in order to maintain a water temperature of 37°–40° C. The water must be changed at the latest after half the expected capacity of the chemicals is reached; at low machine throughputs a daily water change is recommended. Insufficient water change leads to cyan stain on the prints.

Drying

For CIBACHROME COPY PAPER and CIBA-CHROME COPY FILM the air temperature in the drier must not exceed 70° C. Good air circulation dries more efficiently than high temperature. If the drier temperature is too high, the photomaterial, in particular CIBACHROME COPY PAPER, tends to curl and consequently may block the drier. Furthermore, in extreme cases, the surface sheen may be affected. The drier temperature should be adjusted so that the prints are just dry when leaving the machine. Avoid overdrying!

In machines with a built-in drier the surface water should be removed by means of squeegee rolls at the entry of the drier.

If the machine has no drier, the prints may be placed in a drying cabinet at elevated temperature or hung in a dust-free room at normal temperature. The surface water should first be removed with a soft rubber blade (e.g. a windscreen wiper).

The first step of wetting the PSM BEFORE radiation exposure in the most crucial step in the present invention. All of the following examples and all practical applications of the present invention utilize the reducing agents formula based on the structure following:

For photographic imaging purposes it is necessary to utilize processing solutions containing a suitable reducing agent(s) (or derivatives thereof) which is able to cause the silver halides (bromide, iodide, or chloride of silver) in the PSM to be converted into metallic silver in proportion to the amount of radiation the silver halides receive during exposure. Agents having such capabilities may be described according to their structure by the well known Kendall-Pelz rule for coplanar conjugated systems as follows:

$$a—(A{=}B)_n—a'$$

Where:

A is carbon
B is carbon or nitrogen
a and a' are hydroxyls (OH), aminos ($NH_2$), or substituted amino groups such as ($NHR_1$ or $NR_1R_2$)
n is an integer Not limited to, but included among agents having such reduction capabilities suitable for use with the present invention are the following:

m-Hydroxymethyl-p-hydroxyaniline hydrochloride
n-Methyl-p-aminophenol
o-Diaminobenzene dihydrochloride
o-Diaminobenzene
o-Dihydroxybenzene
p-Aminophenol
p-Amino-o-cresol hydrochloride
p-Benzylaminophenol
p-Diaminobenzene dihydrochloride
p-Diaminobenzene
p-Dihydroxybenzene
p-Methyl-aminophenol sulfate
p-Phenylenediamine
1, 2-Diaminobenzene
1, 2, 3-Trihydroxybenzene
1, 3, 5-Triamino-2-hydroxybenzene
1, 4-Aminophenol
1, 4-Aminophenol hydrochloride
1, 2-Hydroxybenzene
1, 3-Dihydroxybenzene
1, 4-Dihydroxybenzene
1, 4-Diaminobenzene
1, 4-Diaminobenzene dihydrochloride
1, 2-Diaminobenzene
1, 2-Diaminobenzene dihydrochloride
1-(p-Aminophenyl)-3-aminopyrazolidone
1-Hydroxy-2, 4-diaminobenzene dihydrochloride
1-hydroxy-2-methylaminobenzene o-methyl-aminophenol sulfate
1-hydroxy-4-methanol amino benzene sulfate
1-Phenyl-3-pyrazolidon 1-Phenyl-4, 4-dimethyl-3-pyrazolidone
1-Phenyl-4, 4-dimethyl-3-pyrazolidone
1-Phenyl-4-methyl-3-pyrazolidone
2, 4-Diaminophenol
2, 4-Diaminophenol dihydrochloride
2, 3-Dihydroxybenzene
2-Bromo-1, 4-dihydroxybenzene
2-Chloro-1, 4-dihydroxybenzene
4-Hydroxyphenyl-amino-acetic acid
4-Mehtyl-1-phenyl-3-pyrazolidone
Aminosalicylic acid
Ascorbic acid
Hydroquinone
N, N-Dialkyl-p-phenylenediamine
N-(4-hydroxyphenyl)-glycine
Sodium a-aminoapthol-disulfonate
Sodium aminonaptholsulfonate
Sodium p-aminophenolate

EXAMPLE 1

Utilizing the C&CC method, the steps are as follows:

STEP 1: The above noted PSM was wetted in a mechanism containing a solution of 1-phenyl-3 pyrazolidone and hydroquinone developing agents in combination with an alkaline buffering compound, preservative compounds, anti-fogging agents, alcohols, salts, and water for a period of 90 seconds at 95° F.

STEP 2: Excess chemical was then removed by squeegeeing with an integral roller mechanism.

STEP 3: The moist PSM was positioned under the exposing station.

STEP 4: The PSM was exposed using a 35 mm positive color transparency as an original for a period of 90 seconds at f/5.6.

STEP 5: After the exposure was completed, the PSM was then transported into a processing mechanism which wetted the material with a solution containing an identical chemical mixture to that in Step 1 above.

STEP 6: The PSM was then wetted with chemical mixtures following the manufacturers recommendations as outlined in Steps C through F above.

FORMULA USED FOR STEPS 1, 2 & 3 IN EXAMPLE 1

| SUBSTANCE | RANGE |
|---|---|
| Potassium Sulfite | 8–15 gms |
| Potassium Metaborate | 3–10 gms |
| Potassium Bromide | 0.5–2 gms |
| 1-phenyl-3-pyrazolidone | 2–10 gms |
| Hydroquinone | 0.1–2.5 gms |
| Benzotriazole | 0.1–2 gms |
| Diethylene Glycol | 5–50 ml |
| Water | to make 1,000 ml |

The visual characteristics displayed in the resulting print vary considerably from those obtained following the manufacturer's recommendations. The contrast range modification achieved by using the C&CC method outlined above gives typical results of 1,000:1 enabling virtually the entire contrast range contained in the original transparency to be fully depicted on the paper print.

EXAMPLE 2

By utilizing the same sequence of steps exactly as described above in Example 1 except changing the exposure time in step 4 to 60 seconds at f/4, the contrast ratio of the print can be altered. The resulting print will now typically exhibit a contrast range of 500:1

FORMULA USED FOR STEPS 1, 2 & 3 IN EXAMPLE 2

| SUBSTANCE | RANGE |
|---|---|
| Potassium Sulfite | 8–15 gms |
| Potassium Metaborate | 3–10 gms |
| Potassium Bromide | 0.5–2 gms |
| 1-phenyl-3-pyrazolidone | 2–10 gms |
| Hydroquinone | 0.1–2.5 gms |
| Benzotriazole | 0.1–2 gms |
| Diethylene Glycol | 5–50 ml |
| Water | to make 1,000 ml |

NOTE:
Further changes in exposure time and/or intensity will produce other contrast ratio variations. This permits an operator to select from a wide variety of possible contrast ratios.

EXAMPLE 3

Spectral response characteristics of PSM can be altered by changing the time used above in step 1 of example 1. By increasing the time to 120 seconds at 95° F., the overall cyan rendition of the resulting print is increased and the overall yellow rendition is decreased. Conversely, by decreasing the time to 60 seconds at 95° F. the cyan level is decreased and the yellow level is increased. The exact amount of alteration can be varied depending on the final result desired. Little measurable response has been noted in the magenta level.

FORMULA USED FOR STEPS 1, 2 & 3 IN EXAMPLE 3

| SUBSTANCE | RANGE |
|---|---|
| Potassium Sulfite | 8–15 gms |
| Potassium Metaborate | 3–10 gms |
| Potassium Bromide | 0.5–2 gms |
| 1-phenyl-3-pyrazolidone | 2–10 gms |
| Hydroquinone | 0.1–2.5 gms |
| Benzotriazole | 0.1–2 gms |
| Diethylene Glycol | 5–50 ml |
| Water | to make 1,000 ml |

EXAMPLE 4

Spectral response characteristics of the PSM can also be altered by changing the temperature used above in step 1 of example 1. By increasing the temperature to 100° F. (for 90 seconds), the overall cyan rendition of the resulting print is increased and the overall yellow rendition is decreased. Conversely, by decreasing the temperature to 90° F. (for 90 seconds), the cyan level is decreased and the yellow level is increased. Again, the exact amount of alteration can be varied depending on the final result desired, and again little measurable response has been noted in the magenta level.

By using the time alteration in example 3 above in combination with the temperature alteration used in example 4, it is possible to achieve large variations in the cyan and yellow response levels. It is also possible to obtain similar characteristic curve modifications by changing the proportions or concentrations of the chemicals used in steps 1 and 3 due to the practical considerations of creating a simple process. This was not done in the example.

While traditional "filtration" techniques which can only shift spectral response curves in a parallel direction, the C&CC method permits actual alteration of the angles of such curves. This permits obtaining color balances that are close to being optimal, and when combined with the ability to control the contrast ratios as previously outlined, the overall visual characteristics of the resulting prints are superior to those produced by other direct processes. The C&CC method requires no intermediate steps which can degrade the image.

| FORMULA USED FOR STEPS 1, 2 & 3 IN EXAMPLE 4 | |
|---|---|
| SUBSTANCE | RANGE |
| Potassium Sulfite | 8–15 gms |
| Potassium Metaborate | 3–10 gms |
| Potassium Bromide | 0.5–2 gms |
| 1-phenyl-3-pyrazolidone | 2–10 gms |
| Hydroquinone | 0.1–2.5 gms |
| Benzotriazole | 0.1–2 gms |
| Diethylene Glycol | 5–50 ml |
| Water | to make 1,000 ml |

II=BLACK AND WHITE PROCESS

A commercially available high contrast, negative acting, monochromatic (black & white) photosensitive bromide paper was used in Examples 5 and 6 as the PSM. This PSM when processed according to the manufacturer's recommendations has an exposure input range of approximately 8:1. Black and white photosensitive materials exhibiting such high contrast characteristics are not normally suitable for reproducing visually satisfactory prints from continuous tone originals such as black and white panchromatic film negatives with high contrast ratios.

EXAMPLE 5

The manufacturer recommend procedure for using this particular PSM product is: Step A—Exposure to a source of visible light. Following exposure, the recommended chemical processing sequence is: Step B—Development; Step C—Stop bath; D—Fixing; Step E—Washing; Step F—Drying.

Utilizing the C&CC method for contrast control, the steps are as follows:

STEP 1: The above material was wetted in a mechanism containing a solution of sulfate of monomethyl-para-amino-phenol and hydroquinone developing agents in combination with alkaline buffering compounds, preservative compounds, anti-fogging agents, salts and water for a period of 60 seconds at 72° F.

STEP 2: Excess chemical was then removed by squeegeeing with an integral roller mechanism.

STEP 3: The moist PSM sheet then was positioned at the exposing station.

STEP 4: The material was exposed using a 35 mm black and white panchromatic negative as an original for period of 60 seconds at f/4.

STEP 5: After the exposure was completed, the material was then transported into the next processing step which further wetted the PSM with a solution containing an identical chemical mixture as that in Step 1 above for 30 seconds at 72° F.

STEP 6: The material was then wetted with additional chemical mixtures following manufacturers recommendations as outlined in C through F in example 5 above.

The visual characteristics displayed in the resulting print vary considerably from those obtained following the manufacturer recommendation. The contrast range modification achieved by using the C&CC method outlined above gives typical results of 500:1. This range can easily reproduce the entire contrast range contained in the original negative.

| FORMULA USED FOR STEPS 1, 2 & 3 IN EXAMPLE 5 | |
|---|---|
| SUBSTANCE | RANGE |
| Sulfate of mono-methyl-para-amino-phenol | 2–4 gms |
| Hydroquinone | 10–15 gms |
| Sodium sulfite | 40–50 gms |
| Sodium carbonate | 60–70 gms |
| Potassium bromide | 1.5–2.5 gms |
| Water | to make 3,000 ml |

EXAMPLE 6

By making the following changes, it is possible to further alter the contrast ratio as follows:

STEP 1: The above PSM was wetted in a mechanism containing a solution of sulfate of mono-methyl-para-amino-phenol and hydroquinone developing agents in combination with alkaline buffering compounds, preservative compounds, anti-fogging agents, salts, and water, but for a period of 30 seconds at 72° F.

STEP 2: Excess chemical was then removed by squeegeeing with an integral roller mechanism.

STEP 3: The moist PSM sheet was then positioned at the exposing station.

STEP 4: The PSM was exposed using a commercially available photographic enlarger using the same black and white panchromatic negative as an original as used in Example 5, but for a period of 25 seconds at f/5.6.

STEP 5: After the exposure was completed, the PSM was then transported into the next processing step which further wetted the material with a solution containing an identical chemical mixture as those in Step 1 above but for 75 seconds at 72° F.

STEP 6: The PSM was then wetted with additional chemical mixtures following manufacturers recommendations as outlined in C through F (Example 5) above.

The visual characteristics of the resulting print now exhibit a typical contrast ratio reproduction of approximately 160:1.

| FORMULA USED FOR STEPS 1, 2 & 3 IN EXAMPLE 6 | |
|---|---|
| SUBSTANCE | RANGE |
| Sulfate of mono methyl-para-amino phenol | 2–4 gms |
| Hydroquinone | 10–15 gms |
| Sodium sulfite | 40–50 gms |
| Sodium carbonate | 60–70 gms |
| Potassium bromide | 1.5–2.5 gms |
| Water | to make 3,000 ml |

When a PSM is used following manufacturer's recommendations, several combinations of time and illuminance can be used to achieve the same exposure results, (exposure=illuminance×time). E.G. if 100 units of exposure are required to produce a given desired result, it makes no difference whether 5 units of time are used with 20 units of illuminance, or 2 units of time are used with 50 units of illuminance. The overall result will be the same, and the contrast characteristics will remain unchanged since these characteristics are normally considered to be inherent in the material. (This of course is a general rule and does not consider reciprocity effects often encountered when using extreme variations in exposure times.)

This is not true when using the C&CC method. Unlike the previous example, using the same combinations of time and illuminance as above, the results will show a marked difference in the contrast characteristics of the PSM. The variations in the contrast characteristics are obtained by changing the time and illuminance as explained in Examples 1 and 2 and depicted in FIGS. 7 and 8.

Changes in color balance are obtained by modifications in time and temperatures as outlined in Examples 3 and 4 and depicted in FIG. 8.

Black and white is as explained in the text.

Depending on magnification factors, the exposure time usually ranges between 1–150 sec. and it was this range that was used in all of the above examples.

The removal of excess photoreactive chemicals in all the above examples prior to exposure is necessary to form a non-beading (non-distorting) uniform layer of photoreactive chemical atop the PSM.

DETAILED DESCRIPTION OF THE DRAWINGS

In FIG. 6 the typical characteristic curves of each of the three color layers obtained by processing the color photosensitive material according to the manufacturer's recommendations depicts high contrast. The cyan curve 2 is not closely aligned with the magenta 1 or the yellow 3. Such a material will not produce a satisfactory print without corrective color filtration to align the cyan curve more closely with yellow 3 and magenta 1 curves. It will not reproduce all of the tones recorded in the original since the normal ability of this material to depict tones is quite narrow as can be seen on the y-z axis.

Also shown in FIG. 6 is a "crossover" between the magenta 1 and yellow 3 curves. This means that the darker tones in a print will show slight magenta predominance while the lighter tones will show a slight predominance of yellow. Color filtration cannot normally correct such "crossovers" since any shift created by making filter corrections on one side of the crossover intersection only makes the situation worse on the other side of the intersection as shown in FIG. 10.

In FIG. 7 the typical characteristic curve of each of the three color layers depicts the results obtained by processing the same material with the C&CC method as performed in Example 1. It can be seen that the shape of the curves 1, 2, 3, has changed, the contrast range has been extended greatly (shown on y-z), and the "crossover" has been virtually eliminated. Any small misalignment in the curves can now be corrected with normal color correction filtration if desired.

In FIG. 8 the results of using the C&CC method as performed in Example 2 again improves the characteristic curve performance of each of the three color layers, but this time the contrast range of the print is not as great as can be seen on axis y-z. Prints made using this particular variation of the C&CC method will exhibit more contrast which may be desirable depending on the contrast characteristics of the original.

In FIG. 9 the shape of the curves is altered using the C&CC methods described in Example 3 and 4. The use of normal color correction filtration can usually only cause an essentially parallel shift in the position of a curve as shown in FIG. 10 and cannot usually correct a "crossover" situation such as exists with the material depicted in FIG. 6.

FIG. 10 depicts the typical characteristic curve of each of the three color layers obtained by using the manufacturer's recommended processing, but altering the color balance with color filtration. Although the cyan curve was shifted it can be seen that such filtration did not alter the contrast characteristics.

In FIG. 11 the typical characteristic curve of the black and white PSM obtained by using the manufacturer's recommended processing for a high contrast black and white PSM is shown. As can be seen by the shape of the curve 4 the contrast range of this material is normally extremely high. Prints made with such material would usually be capable of depicting only black or white tones and essentially incapable of reproducing any intermediate tones between the two extremes. This type of material is obviously not suitable for making normal continuous tone prints.

FIG. 12 depicts the typical characteristic curve of the black and white PSM obtained by processing the same black and white PSM by using the C&CC method as in Example 5. As can be seen on the y-z axis the contrast range has been extended thus permitting the material to reproduce intermediate tones as well as black and white.

DETAILED DESCRIPTION OF THE APPARATUS INVENTION

In the accompanying drawings there is shown a combined transporting, exposing and processing apparatus for film. The present disclosure is directed, by way of the illustrations, to the use of the complete embodiment of the applicant's invention in two variations with a mono-sheet, silver-dye-bleach color photosensitive material and processing system coupled with a photographic enlarger. Also shown is a variation of the present invention for use in processing diffusion transfer type materials. It will be understood, however, that the present invention may be used with other imaging methods, devices and processing systems in which a sheet of photosensitive material is placed upon a platen, exposed to a source of visible or invisible radiant energy capable of producing an image thereon or latent image thereon and thereafter developed.

By the terms "film" or "paper" as used herein, it is intended to mean any material such as a sheet of paper, plastic, glass, foil, rubber or metallic foil having a photosensitive, layer thereon or capable of producing an image of an object created by means of visible or invisible radiant energy.

It is not intended that the present invention be limited in any manner to any specific type of photosensitive material or process. The materials used in the illustrations are solely for purposes of illustration.

Figure 2:
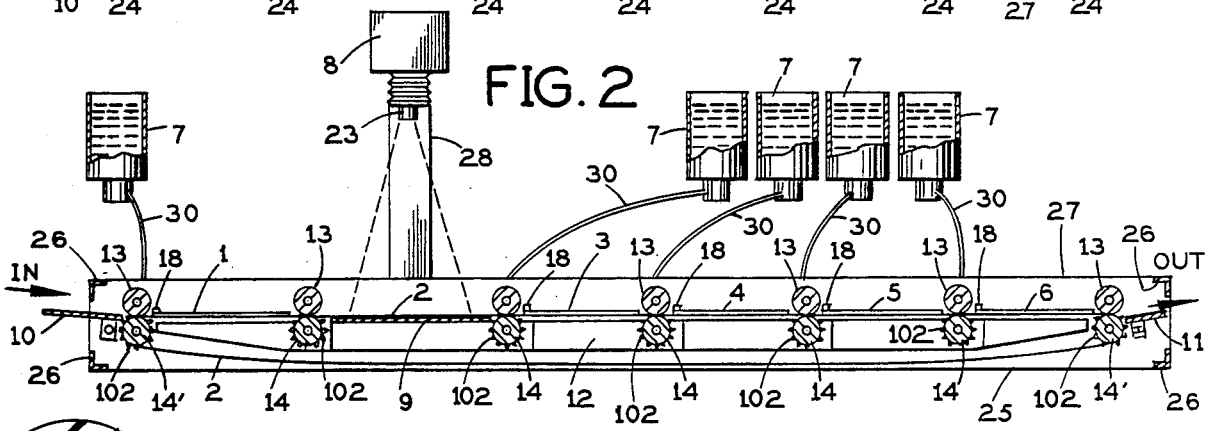
FIG. 2 is a sectional view in side elevation of the embodiment taken along line 2—2 in FIG. 1.

Referring to FIGS. 1 and 2 there is shown a combined transporting, exposing and processing apparatus for film 20 mounted upon a frame 27. The frame 27 is formed of spaced horizontal members 25 secured by top and bottom cross members 26 secured to said horizontal members. All frame members are preferably made of rigid metal. The frame is shrouded with a housing (not shown) to prevent unwanted light from entering light controlled areas. The frame 27 is fitted with a well known enlarger consisting of an internal light source 8 and a lens 23 secured by the column 28 to the frame 27. A tray 12 is mounted underneath the belt.

Mounted within the frame 27 is an endless plastic belt 2 carried on a series of sprocketed rollers 14 rotatably mounted to the frame. The belt 2 is shown in this embodiment as perforated along the two edges with equidistant holes 101. The sprocketed rollers 14 are preferably made of a rigid metal shaft covered with plastic. The rollers 14 are driven by belt 2 by means of teeth 102 on rollers 14. Motor 15 with linkage 29 drives roller 14' which drives belt 2. Mounted upon the top surface of the belt 2 are a series of resilient rollers 13 rotatably mounted to the frame 27 and fitted with gears 24. Gears 24 are driven by similar gears (not shown) on the ends of rollers 14. Rollers 13 are preferably made of a rigid metal shaft covered with a suitable resilient covering such as a rubber. The belt 2 passes between the two series of rollers 13, 14. On opposite ends of the frame 27 infeed guide plate 10 and outfeed guide plate 11 are secured.

Mounted upon the uppermost side of the belt 2 are a series of mesh assemblies 1,3,4,5,6 which are held in position by a rigid plastic channel 18 inserted on each end into slots (not shown) in the sides of frame members 25.

Figure 3:
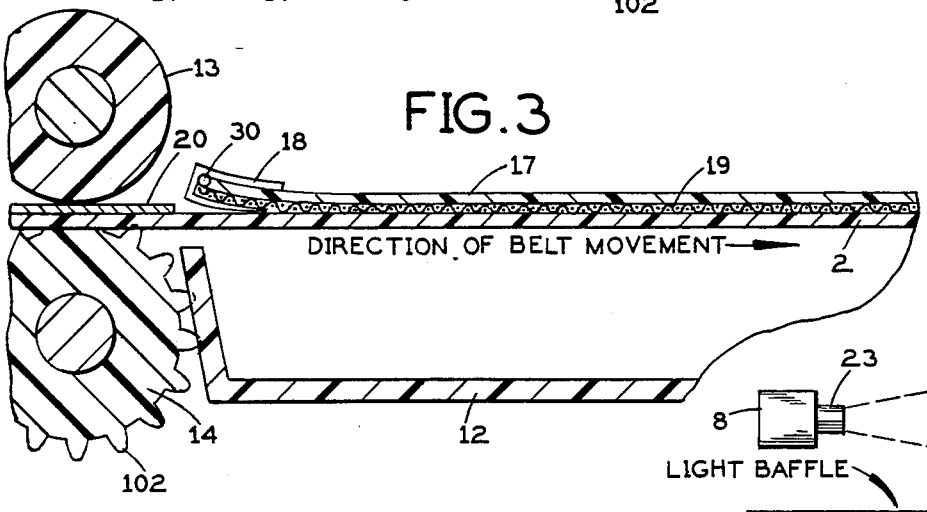
FIG. 3 is an enlarged detailed view of a portion of the inlet end of the apparatus depicted in FIG. 2.

As best shown in FIG. 3 the rigid plastic channel 18 is cemented to a flexible plastic sheet 17 and a mesh screen 19 and fitted on to a plastic hose 30. The opposite end of the channel 18 is sealed and the opposite end of the hose 30 is connected to one of the controlled flow liquid reservoirs 7.

Figure 4:
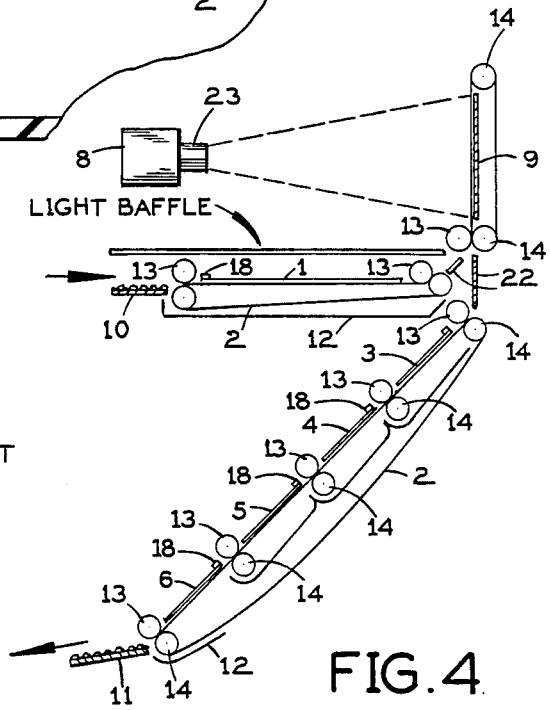
FIG. 4 is a side elevation schematic of another embodiment of the present invention.

FIG. 4 depicts another embodiment of the invention shown in a side elevation schematic view. In this embodiment the belt 2 is separated into three independent sections which permit a more compact arrangement. In this embodiment the mesh assembly in station 1 is modified by securing the mesh 19 to the flexible plastic sheet 17 on both ends with a plastic channel 18. The PSM is inserted at the infeed plate end 10, and it immediately is adhered to a belt 2 in the same manner as used in the previous embodiment. After the PSM reaches the center of the mesh assembly 1, the motor (not shown in this figure) is stopped and the direction of movement reversed for a short distance (typically ½"). Then it is stopped and reversed again for an equal distance. This creates a reciprocating action which agitates the solution. After remaining in station 1 for a pre-set time the PSM is advanced to the next squeegee roller 13 wherein the adhesion between the belt 2 and the PSM is broken. The PSM is then directed by a guide plate 22 and adhered to another belt 2 by roller 13 supported by platen 9 and continues traveling until it is centered with respect to the enlarger lens 23. The enlarger light source is turned on and exposes the PSM. After exposure, the belt 2 direction is reversed and the material passes beneath the same roller 13—breaks the surface tension bond—and is directed by a plate 22 into the station 3 infeed nip roller where it is re-adhered to the next belt 2. The following steps are a repeat of the previous embodiment except that the belts are arranged at a 45° angle. After exiting station 6 the PSM is then directed into a dryer or catch tray.

Figure 5:
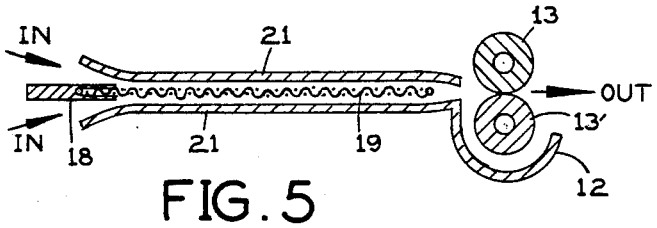
FIG. 5 is a cross sectional schematic in side elevation of another embodiment of the present invention which is capable of processing diffusion transfer materials.

FIG. 5 depicts yet another embodiment of the invention in which the photosensitive material utilized is a two sheet diffusion transfer type. Either, both, or neither of the sheets may be wet prior to entering the chamber created by two rigid guide plates 21 made of a suitable material such as plastic or metal and separated by a space in which a mesh 19 is secured in place by a plastic channel 18. In operation the two separate sheets of material required for this type of process enter the chamber driven by external means (not shown) on opposite sides of the channel 18 continuing to where they come into intimate contact with the mesh 19 wetted with a chemical solution in a manner similar to that depicted in FIG. 1. The PSM continues moving at a pre-determined constant speed passing the end of the mesh 19 where the two separate sheets come together and simultaneously enter the nip between the two rollers 13 and 13'. The two rollers squeegee the two sheets together removing both excess air and solution in a continuous action until the trailing edge of the resulting "sandwich" clears the rollers 13 nip on the outfeed side. The sandwich is left together for a period of time and then separated to dry or for subsequent washing or additional processing.

The reason for the existance of this type material is that cameras without reversing prisms would create "wrong reading" images on paper prints (also called "stats"); in other words, the type would be backwards. By recording the image on one sheet of material and then "transferring" it to another sheet (in this case by chemical means) the resulting image is put back into proper orientation (right reading). A similar situation exists when a wrong reading rubber stamp prints right reading words on a piece of paper.

I claim:

1. A method of radiantly imaging silver-based photosensitive material from original subject matter or images of the original subject matter, comprising the steps of:

(a) wetting the photosensitive material with a chemical having the ability to develop an image on said photosensitive material, react with a silver-based photosensitive site in said photosensitive material contemporaneously with or subsequent to exposure of such site to radiation for a period of time and at a temperature sufficient for said chemical to substantially fully penetrate the volume of said photosensitive material, to thereby position said chemical in relatively close proximity to the silver-based photosensitive sites of said photosensitive material;

(b) thereafter removing the excess photoreactive chemicals, thereby forming a non-beading uniform layer of said chemical atop said photosensitive material;

(c) thereafter radiating the photosensitive material with the image of said original subject matter for a period of time sufficient to produce a latent image therein;

(d) thereafter processing said image-bearing photosensitive material through a series of steps selected from the group of steps comprising developing bleaching, fixing, washing, second development, stabilizing and drying.

2. The method of claim 1(a), wherein said photoreactive chemical comprises:

a solution of 1-phenyl-3-pyrazolidone (2–10 gms), and hydroquinone developing agents (1–2.5 gms), potassium sulfite (8–15 gms), potassium metaborate (3–10 gms), potassium bromide (0.52–2 gms), benzotriazole (0.1–2 gms), diethylene glycol (5–50 ml), and water to make 1000 ml).

3. The method of claim 1(a), wherein said photoreactive chemical comprises:

a solution of sulfate of mono-methyl-paraaminophenol (2–4 gms), hydroquinone (10–15 gms), sodium sulfite (40–50 gms), sodium carbonate (60–70 gms), potassium bromide (1.5–2.5 gms) and water (to make 3000 ml).

4. The method of claim 1(a), wherein said selected period of time ranges between 1 and 150 seconds.

5. The method of claim 1(a), wherein said controlled temperature ranges between 65 and 120 degrees Fahrenheit.

6. The method of claim 1(c), wherein said radiating step further comprises the steps of (a) radiating said original subject matter or image of the original subject matter with a light source;

(b) focusing said radiated light collected from said original subject matter or image of the original subject matter onto said photosensitive material through a lens having a variable f stop.

7. The method of claim 6(a), wherein said light source further comprises 85 watts, or more, power having a nominal color temperature of 3,200° Kelvin.

8. The method of claim 6(b), wherein said variable f stop ranges between f/1.4 and f/22.

9. The method of claim 1(c), wherein said selected period of time ranges between 1 and 150 seconds.

10. A method of radiantly imaging a silver based photosensitive material from original subject matter or images of the original subject matter comprising the steps of:

(a) wetting the photosensitive material with a photographic reducing agent having a chemical structure in the class described within the Kendall-Pelz rule for coplanar conjugated systems, for a period of time and temperature sufficient for said reducing agent to substantially fully penetrate the volume of said photosensitive material, to thereby position said reducing agent in relatively close proximity to the silver-based photosensitive sites of said photosensitive material;

(b) thereafter removing the excess reducing agent, thereby forming a non-beading uniform layer of reducing agent atop said photosensitive material;

(c) thereafter radiating the photosensitive material with the image of said original subject matter or image of the original subject matter for a period of time sufficient to produce a latent image therein;

(d) thereafter processing said image-bearing photosensitive material through a series of steps selected from the group of steps comprising developing, fixing, washing, second development, stabilizing and drying.

11. The method of claim 1 wherein said chemical is partially absorbed and partially adsorbed by said photosensitive sites.

12. The method of claim 1 wherein during said radiating step said chemical partially reacts with said photosensitive sites to begin development of said latent image.

13. The method of claim 12 wherein said development proceeds at said photosensitive sites essentially simultaneously with said radiating of the photosensitive material.

14. The method of claim 10 wherein said chemical is partially absorbed and partially adsorbed by said photosensitive sites.

* * * * *